United States Patent [19]

McIlhatten

[11] Patent Number: 5,075,974

[45] Date of Patent: Dec. 31, 1991

[54] CUTTER FOR FIBROUS COMPRESSIBLE MATERIAL

[76] Inventor: Edward T. McIlhatten, 40 Old County Rd., Hudson, Mass. 01749

[21] Appl. No.: 557,567

[22] Filed: Jul. 24, 1990

[51] Int. Cl.[5] ..... B26B 29/00; B26B 29/02

[52] U.S. Cl. ..... 30/290; 30/286; 30/294

[58] Field of Search ..... 30/286, 278, 272.1, 30/179, 178, 177, 164.7, 290, 294

[56] References Cited

U.S. PATENT DOCUMENTS

| | | | |
|---|---|---|---|
| 1,133,753 | 3/1915 | Shortridge | 30/286 |
| 1,665,836 | 4/1928 | Baker | 30/286 |
| 2,743,523 | 5/1956 | Honey | 30/286 |
| 2,876,539 | 3/1959 | Ford | 30/286 |
| 3,009,246 | 11/1961 | Witherby | 30/286 |
| 4,587,735 | 5/1986 | Walters et al. | 30/286 |
| 4,757,612 | 7/1988 | Peyrot | 30/286 |
| 4,890,386 | 1/1990 | Collier | 30/272.1 |

FOREIGN PATENT DOCUMENTS

| | | | |
|---|---|---|---|
| 294138 | 3/1932 | Italy | 30/286 |

*Primary Examiner*—Douglas D. Watts
*Assistant Examiner*—Paul M. Heyrana, Sr.
*Attorney, Agent, or Firm*—Blodgett & Blodgett

[57] ABSTRACT

A cutting tool for cutting a sheet of compressible fibrous material. The cutting tool includes a blade which forms part of a cutting assembly which is mounted on a supporting base for movement between an upper position in which the blade is located above the material to be cut when the supporting base rests on the material which is to cut to a lower position in which the cutting blade extends below the supporting base. The cutting assembly is biased to the upper position and moved to the lower position by downward pressure from the hand of the operator which also causes the supporting base to compress the fibrous material so that when the cutting tool is moved longitudinally along the upper surface of the fibrous material, the material is cut by the blade.

5 Claims, 1 Drawing Sheet

CUTTER FOR FIBROUS COMPRESSIBLE MATERIAL

BACKGROUND OF THE INVENTION

The present invention is directed to a cutting tool for cutting fibrous compressible material, such as a sheet of fiberglass insulation. Cutting this type of material is a very difficult and awkward task even for professional installers of this material. The material can be cut with a large pair of scissors but this procedure is very time consuming. The conventional utility knife is usually the cutting tool of choice by most professionals. Due to the looseness and compressibility of the material, several passes of the knife are usually required to cut the material. An elongated straight edged tool is usually used to compress the fiber sheet of material and to guide the knife along a predetermined line of cutting. However, even this procedure is less than satisfactory. Care must be used to avoid hitting the guide edge of the compressing tool with the blade of the utility knife which increases the cutting time. Although the fibrous material is compressed along the guide edge of the compressing tool, the fibrous material extends upwardly abruptly from the guide edge of the compressing tool, thereby making it difficult to cut the fibrous material. Also, since the operator has one hand on the compressing tool and one hand on the utility knife, he or she is unable to grasp the portion of the fibrous material which is being cut off and to prevent it from being dragged forwardly by the knife and interfering with the execution of a smooth, clean cut. These and other difficulties experienced with the prior art insulation cutting tools have been obviated by the present invention.

It is, therefore, a principle object of the invention to provide a cutting tool for fibrous compressible material which does not require the use of any other tool.

Another object of this invention is the provision of a cutting tool for fibrous compressible material which simultaneously compresses and cuts the material.

A further object of the present invention is the provision of a cutting tool for fibrous compressible material which simultaneously compresses and cuts the material and which utilizes a conventional utility knife.

It is another object of the present invention to provide a cutting tool for fibrous compressible material which simultaneously compresses and cuts the material and which can be actuated with one hand so that the other hand of the operator can be used to hold the material which is being cut off or otherwise used to assist in the cutting operation.

A still further object of the invention is the provision of a cutting tool for fibrous compressible material which is simple in construction, which is inexpensive to manufacture, in which is capable of a long life of useful service.

With these and other objects in view, as will be apparent to those skilled in the art, the invention resides in the combination of parts set forth in the specification and covered by the claims appended hereto.

SUMMARY OF THE INVENTION

In general, the invention consists of a cutting tool for sheets of compressible fibrous material. The cutting tool has a supporting base and a cutting assembly which is mounted on the supporting base for movement between an upper position at which a blade, which is part of the cutting assembly, lies above the material to be cut and a lower position at which the cutting blade extends below the cutting assembly and the bottom surface of the supporting base. The cutting assembly is biased to the upper position and is moved to the lower cutting position by pressure from the operator's hand so that the cutting blade extends into the fibrous material and cuts the fibrous material as the cutting tool is moved forwardly along the upper surface of the fibrous material.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
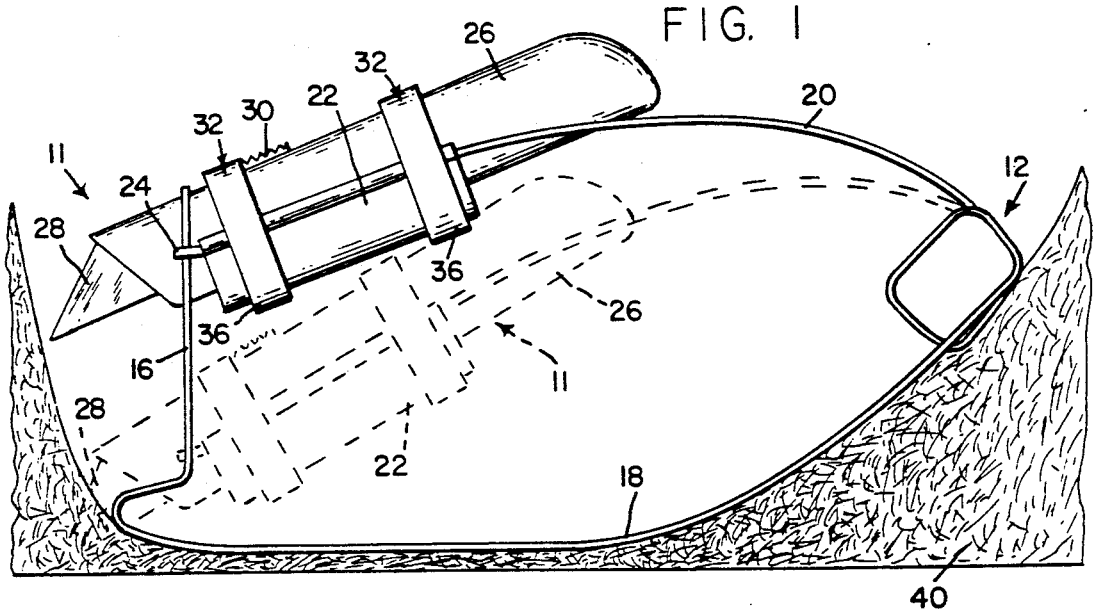
FIG. 1 is a side elevational view of a cutting tool embodying the principles of the present invention.
Figure 2:
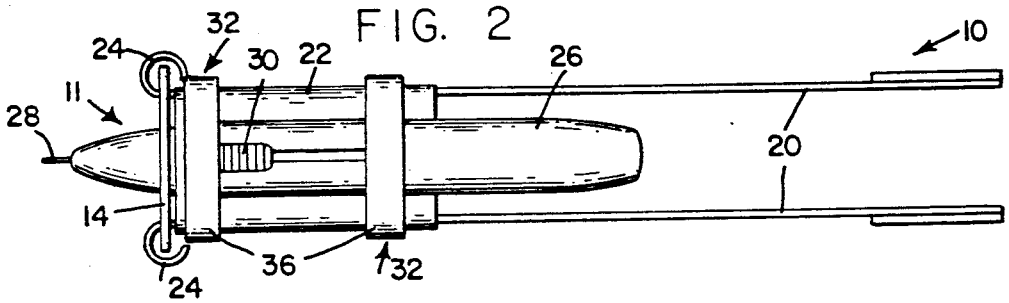
FIG. 2 is a top plan view of the cutting tool.
Figure 3:
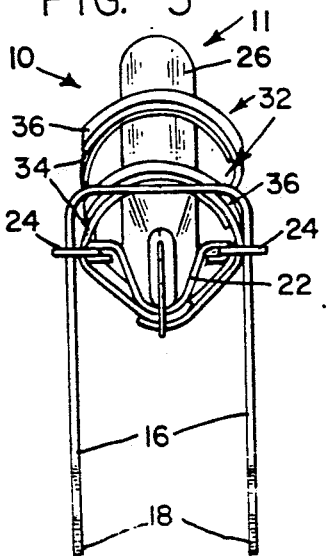
FIG. 3 is a front elevational view of the cutting tool.
Figure 4:
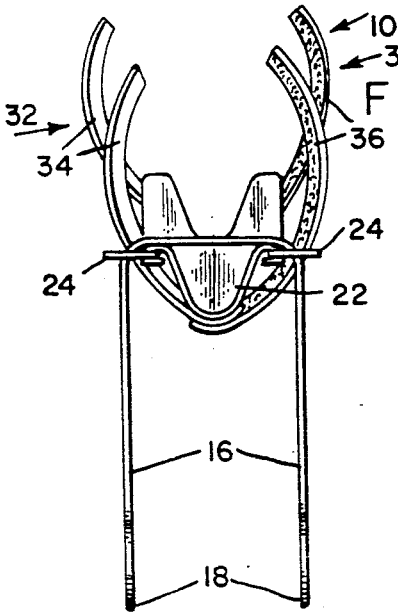
FIG. 4 is a front elevational view without the cutting element.

Referring to the drawings, the cutting tool of the present invention which is generally indicated by the reference numeral 10, is shown as being of the type intended for use with a conventional utility knife which is generally indicated by the reference numeral 11.

The cutting tool 10 includes a wire frame supporting base which is generally indicated by the reference numeral 12 and comprises a pair of spaced vertical guide posts 16 which are connected at the top by a horizontal connecting portion 14. The posts 16 are connected to a pair of generally horizontal slide runners 18 which extend forwardly from the posts 16. A pair of support rods 20 are connected to the slide runners 18 and extend rearwardly in cantilever fashion from the slide runners 18 to the guide post 16. Each support rod 20 extends generally horizontally and has a free end to which is fixed a guide ring 24 which is slidable vertically on one of the guide posts 16. The guide ring 24 of one support rod 20 is slidable on one of the guide post 16 and the guide ring 24 of the opposite support rod 20 is slidable on the opposite guide post 16. A generally U-shaped cradle 22 is fixed to the rearward ends of the support rods 20 adjacent the guide rings 24 for supporting the utility knife 11.

The utility knife 11, which is shown in the drawings, is as an example a standard utility knife which includes a body portion 26 and a cutting blade 28 which is mounted for longitudinal movement relative to the body 26 between an extended position as shown in FIG. 1 to a retracted position wherein the blade is completely enclosed within the body 26. The movement of the blade 28 relative to the body 26 is accomplished by means of a finger operated slide button 30. When the utility knife 11 is mounted within the cradle 22, as shown in FIG. 1, the blade 28 extends rearwardly and downwardly relative to the cutting tool 10. The utility knife 11 is maintained on the cradle 22 in a fixed position by means of a pair of straps 32. In the particular embodiment shown in the drawings, the straps 32 comprise a first portion 34 which has a fibrous outer surface and a second portion 36 which has an inner surface consisting of a plurality of small hooks of a textile material of the type shown in U.S. Pat. No. 2,717,437. One end of the first portion 34 is fixed to the cradle 26. The other end of the first portion 34 extends freely so that it can be looped about the utility knife. One end of the second portion 36 is also fixed to the cradle 22. The other end of the second portion 36 extends freely so that it is looped around the utility knife 11 and secured to the first portion 34. Other types of fastening elements, such as snap fasteners can be used to secure the first and second portions 34 and 36, respectively.

The wire frame 12 is made of a flexible resilient material, such as spring steel. The cradle 22 is normally biased in the upper full line position shown in FIG. 1 by the cantilever end support rods 20. The utility knife 11 and the cradle 22 can be moved to the lower dotted-line position shown in FIG. 1 by applying downward pressure to the utility knife.

The cutting tool 10 is utilized for cutting a sheet of fibrous material, such as fiberglass insulation, by placing the tool so that the slide runners 18 rest on the upper surface of the material to be cut which is indicated by the reference numeral 40 in FIG. 1. The operator utilizes the tool by grasping the utility knife 11 and applying downward pressure on the knife so that the slide runners 18 compress the fibrous material and moves the utility knife 11 from the full-line position to the dotted-line position shown in FIG. 1. This causes the rearwardly extending blade 28 to penetrate the fibrous material 40. The cutting tool 10 is then moved forwardly along the surface of the material 40 with the utility knife in the lowered position so that the fibrous material is progressively compressed and cut. The entire cutting operation can be accomplished with one hand, thereby leaving the operator's of a hand free to be utilized for assisting in the cutting operation. By simultaneously compacting and cutting the fibrous material, the material is cut easily and cleanly with one pass of the knife.

In the embodiment shown and described, the cutting tool 10 is adapted to receive a conventional utility knife. If desired, the cutting element can be a permanent part of the tool wherein the cutting element comprises a body portion which is permanently fixed to the support rods 20 and a cutting blade which is mounted in the body, preferably in the same manner as the blade of a conventional utility knife.

Another advantage of the cutter of the present invention is that the cutter makes a more compact and cleaner cut of fibrous material. This causes a substantial reduction in airborn fibers which help to make the work environment more comfortable.

Clearly, minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

I claim:

1. A cutting tool for cutting a sheet of compressible fibrous material comprising:

(a) an elongated supporting base which has a front end, a rear end, and an elongated substantially horizontal bottom surface for resting on the upper surface of fibrous material which is to be cut and for guiding the cutting tool longitudinally along said upper surface, (b) a cutting assembly which is normally spaced above the supporting base and which has a rearwardly extending cutting blade, said cutting assembly being supported on said base by a U-shaped cradle for vertical movement relative to said horizontal bottom surface between an upper position at which said blade is located above the said bottom surface and a lower position at which at least a portion of said cutting blade is below the cutting assembly and said bottom surface, and (c) biasing means for yieldingly maintaining said cutting assembly in said upper position, wherein downward pressure on said cutting assembly from an operator's hand which is sufficient to overcome the biasing force of said biasing means for moving said cutting assembly to said lower position also causes the supporting base to compress the fibrous material so that said cutting blade extends into said compressed fibrous material and cuts said compressed fibrous material as said cutting tool is moved forwardly and longitudinally along the upper surface of the fibrous material while maintaining downward pressure on said cutting assembly.

2. A cutting tool as recited in claim 1, wherein said cutting assembly comprises:

(a) a conventional utility knife which includes a planar blade, (b) a cradle for supporting said utility knife, and (c) connecting means for releasably holding said utility knife in a stationary position on said cradle.

3. A cutting tool as recited in claim 2, wherein said connecting means comprises:

(a) a strap which is fixed to said cradle, and (b) means for securing said strap so that the strap is looped about the utility knife for clamping the utility against the cradle in a stationary position.

4. A cutting tool for cutting a sheet of compressible fibrous material comprising:

(a) a supporting base which has a front end, a rear end, and an elongated substantially horizontal bottom surface for resting on the upper surface of fibrous material which is to be cut and for guiding the cutting tool longitudinally along said upper surface, (b) a cradle for supporting a conventional utility knife having a cutting blade which extends from one end of the knife so that when the utility knife is supported on said cradle, the blade extends rearwardly of the cutting tool, said cradle being supported on said base for vertical movement relative to the base between an upper position at which said blade is located above said horizontal bottom surface and a lower position at which at least a portion of said cutting blade is below the cradle and said bottom surface, (c) connecting means for releasably holding said utility knife in a stationary position on said cradle, and (d) biasing means for yieldably maintaining said cradle in said upper position, wherein downward pressure on said cradle from an operator's hand which is sufficient to overcome the biasing force of said biasing means for moving said cradle to said lower position also causes the supporting base to compress the fibrous material so that said cutting blade extends into said compressed fibrous material and cuts said compressed fibrous material as said cutter is moved forwardly and longitudinally along the upper surface of the fibrous material while maintaining downward pressure on said cradle.

5. A cutting tool as recited in claim 4, wherein said connecting means comprises:

(a) a strap which is fixed to said cradle, and (b) means for releasably securing said strap so that the strap is looped about the utility knife for clamping the utility knife against the cradle in a stationary position.

* * * * *